US011241768B2

(12) United States Patent
Yamazaki

(10) Patent No.: US 11,241,768 B2
(45) Date of Patent: Feb. 8, 2022

(54) MAGNETIC POLISHING MACHINE

(71) Applicants: Tsugio Yamazaki, Tokyo (JP); PRIORITY CO., LTD., Tokyo (JP)

(72) Inventor: Tsugio Yamazaki, Tokyo (JP)

(73) Assignees: Tsugio Yamazaki, Tokyo (JP); Priority Co., Ltd., Tokyo (JP)

( * ) Notice: Subject to any disclaimer, the term of this patent is extended or adjusted under 35 U.S.C. 154(b) by 524 days.

(21) Appl. No.: 16/324,516

(22) PCT Filed: Apr. 24, 2018

(86) PCT No.: PCT/JP2018/016664
§ 371 (c)(1),
(2) Date: Feb. 8, 2019

(87) PCT Pub. No.: WO2019/207656
PCT Pub. Date: Oct. 31, 2019

(65) Prior Publication Data
US 2020/0047306 A1 Feb. 13, 2020

(51) Int. Cl.

| | |
|---|---|
| ***B24B 31/112*** | (2006.01) |
| ***B24B 1/00*** | (2006.01) |
| ***B24B 31/10*** | (2006.01) |
| ***B24B 31/033*** | (2006.01) |
| *B24B 37/04* | (2012.01) |

(52) U.S. Cl.
CPC ..... *B24B 31/102* (2013.01); *B24B 1/005* (2013.01); *B24B 31/033* (2013.01); *B24B 31/112* (2013.01); *B24B 37/042* (2013.01)

(58) Field of Classification Search
CPC ..... B24B 1/005; B24B 31/033; B24B 31/10; B24B 31/102; B24B 31/112
USPC ..... 451/32, 34, 35, 36, 326, 327
See application file for complete search history.

(56) References Cited

U.S. PATENT DOCUMENTS

| | | | | |
|---|---|---|---|---|
| 3,730,488 | A | 5/1973 | Gardner, Jr. | |
| 5,044,128 | A * | 9/1991 | Nakano | B24B 31/102 451/32 |
| 5,419,735 | A * | 5/1995 | Imahashi | B24B 1/005 451/104 |

(Continued)

FOREIGN PATENT DOCUMENTS

| | | | |
|---|---|---|---|
| JP | S5511733 | A | 1/1980 |
| JP | H0426981 | B2 | 5/1992 |

(Continued)

OTHER PUBLICATIONS

Patent Cooperation Treaty: International Preliminary Report on Patentability for PCT/JP2018/016664 dated Nov. 5, 2020; 7 pages.

(Continued)

*Primary Examiner* — Eileen P Morgan
(74) *Attorney, Agent, or Firm* — Schwabe Williamson & Wyatt, PC

(57) ABSTRACT

A magnetic polishing machine includes a container which accommodates a polishing target and a plurality of polishing pieces, a plurality of rotation plates which are rotatably disposed below the container while a magnet is attached to the rotation plate, and a first rotation mechanism which rotates each rotation plate about a rotation axis of the rotation plate. The adjacent rotation plates are disposed at a position in which rotation areas thereof partially overlap each other.

9 Claims, 10 Drawing Sheets

(56) References Cited

U.S. PATENT DOCUMENTS

| | | | | | |
|---|---|---|---|---|---|
| 5,662,516 | A * | 9/1997 | You | B24B 1/005 | 451/104 |
| 6,146,243 | A * | 11/2000 | Imahashi | B24B 1/005 | 451/104 |
| 6,231,426 | B1 * | 5/2001 | Liao | B24B 31/102 | 451/32 |
| 7,094,132 | B2 * | 8/2006 | Kremen | B24B 1/005 | 451/103 |
| 2004/0137829 | A1 * | 7/2004 | Park | B24B 37/30 | 451/41 |

FOREIGN PATENT DOCUMENTS

| | | | | |
|---|---|---|---|---|
| JP | H06312362 | A | 11/1994 | |
| JP | H0760635 | A | 3/1995 | |
| JP | H10180611 | A | 7/1998 | |
| JP | 2018-33452 | A * | 4/2018 | B24B 31/112 |
| JP | 6315723 | B1 | 4/2018 | |
| WO | 2006/012094 | A2 | 2/2006 | |

OTHER PUBLICATIONS

International Search Report for PCT/JP2018/016664 dated Jun. 26, 2018; 2 pages.

* cited by examiner

MAGNETIC POLISHING MACHINE

CROSS-REFERENCE TO RELATED APPLICATION

The present application is a national phase entry under 35 U.S.C. § 371 of International Application No. PCT/JP2018/016664, filed Apr. 24, 2018, which designates the United States of America, the entire disclosure of which is hereby incorporated by reference in its entirety and for all purposes.

TECHNICAL FIELD

The present invention relates to a magnetic polishing machine that polishes a polishing target using magnetism.

BACKGROUND ART

Conventionally, a magnetic polishing machine that polishes a polishing target using magnetism is known (for example, see Patent Literature 1). In the magnetic polishing machine, one magnet disc is provided below a container which accommodates a polishing target and a plurality of polishing pieces. The magnet disc is divided into an N pole zone and an S pole zone. A permanent magnet of which an upper surface is an N pole is buried in the N pole zone and a permanent magnet of which an upper surface is an S pole is buried in the S pole zone. Then, when the magnet disc is rotated at a high speed, the plurality of polishing pieces accommodated in the container jump while spinning. Accordingly, the polishing target accommodated in the container is polished.

CITATION LIST

Patent Literature

Patent Literature 1: Japanese Unexamined Patent Publication No. H04-026981

Patent Literature 2: Japanese Unexamined Patent Publication No. H06-312362

SUMMARY OF INVENTION

Technical Problem

In such a magnetic polishing machine, a polishing force is limited to the extent that a magnetic force of the magnet disc reaches, but a permanent magnet is not buried in a center portion of the magnet disc. For this reason, it is difficult to polish the polishing target above the center portion of the magnet disc. Further, when the magnet disc is rotated at a high speed, the polishing piece rotates at high speed about the rotation axis of the magnet disc and hence a centrifugal force is applied to the polishing piece. For this reason, it is difficult to polish the polishing target in the vicinity of the rotation axis of the magnet disc.

Therefore, an object of the invention is to provide a magnetic polishing machine capable of suppressing polishing unevenness.

Solution to Problem

A magnetic polishing machine according to the invention includes; a container which accommodates a polishing target and a plurality of polishing pieces; a plurality of rotation plates which are rotatably disposed below the container while a magnet is attached to the rotation plate; and a first rotation mechanism which rotates the rotation plate about a rotation axis of the rotation plate, in which the adjacent rotation plates are disposed at a position in which rotation areas thereof partially overlap each other.

In the magnetic polishing machine, since the plurality of rotation plates are disposed below the container, the polishing pieces polish the polishing target while being influenced by the magnetic force of each rotation plate. Here, the center portion of each rotation plate is not easily influenced by the magnetic force and a centrifugal force is applied to the polishing piece with the rotation of each rotation plate. However, since the plurality of rotation plates are disposed below the container, the polishing pieces in the entire container are mixed with each other by the centrifugal force of the polishing piece with the rotation of each rotation plate. For this reason, it is possible to suppress a decrease in amount of the polishing target also above the center portion of each rotation plate and in the vicinity of the rotation axis of each rotation plate. Accordingly, it is possible to suppress polishing unevenness.

The container may be disposed above the plurality of rotation plates in a fixed manner. In the magnetic polishing machine, since the container is disposed above the plurality of rotation plates in a fixed manner, it is possible to suppress an increase in size of the entire machine.

The rotation axis of each rotation plate may pass through the container. In the magnetic polishing machine, since the rotation axis of each rotation plate passes through the container, it is possible to densely dispose the rotation plates. Accordingly, it is possible to suppress an increase in size of the entire machine.

Four rotation plates may be disposed below the container. In this case, the rotation plate may have a deformed elliptical shape in which a center portion is thin and both end portions are thick and include a first portion and a second portion extending in mutually opposite directions from the rotation axis of the rotation plate and a plurality of the magnets may be attached to each of the first portion and the second portion. In the magnetic polishing machine, since four rotation plates disposed below the container include the first portion and the second portion extending in the opposite directions from the rotation axis, it is possible to densely dispose four rotation plates. Accordingly, the small polishing pieces can be easily mixed as a whole and the movement of the small polishing pieces can be further complicated.

The rotation plate may be formed in a shape which maintains a substantially uniform separation distance with respect to the adjacent rotation plate when the rotation plate is rotated by the first rotation mechanism. In the magnetic polishing machine, since a separation distance between the adjacent rotation plates is maintained to be substantially uniform when the rotation plate rotates, it is possible to extremely decrease a range not influenced by the magnetic force of the rotation plate and to move the polishing pieces inside the container in a complicated manner. Accordingly, it is possible to further suppress polishing unevenness.

Both of a first magnet disposed so that an upper surface becomes an N pole and a second magnet disposed so that an upper surface becomes an S pole may be attached to one rotation plate as the magnet. In the magnetic polishing machine, since the magnets of opposite polarities are attached to one rotation plate, it is possible to cause the polishing pieces to jump while spinning by the rotation of one rotation plate. For this reason, it is possible to move the polishing pieces in a more complicated manner by rotating the plurality of rotation plates.

Only one of a first magnet disposed so that an upper surface becomes an N pole and a second magnet disposed so that an upper surface becomes an S pole may be attached to one rotation plate as the magnet. In the magnetic polishing machine, since the magnets of the same polarity are attached to one rotation plate, it is possible to easily manufacture the rotation plate. In this case, it is possible to cause the polishing pieces to jump while spinning by attaching the magnets of opposite polarities to the adjacent rotation plates.

The magnetic polishing machine may further include a support member that rotatably and integrally rotates the rotation plates and a second rotation mechanism which rotates the support member. In the magnetic polishing machine, the second rotation mechanism rotates the support member so that the rotation axis of each rotation plate rotates about the rotation axis of the support member. Accordingly, since it is possible to further promote the mixing of the polishing pieces, it is possible to further suppress polishing unevenness.

Advantageous Effects of Invention

According to the invention, it is possible to suppress polishing unevenness.

DESCRIPTION OF EMBODIMENTS

Figure 1:
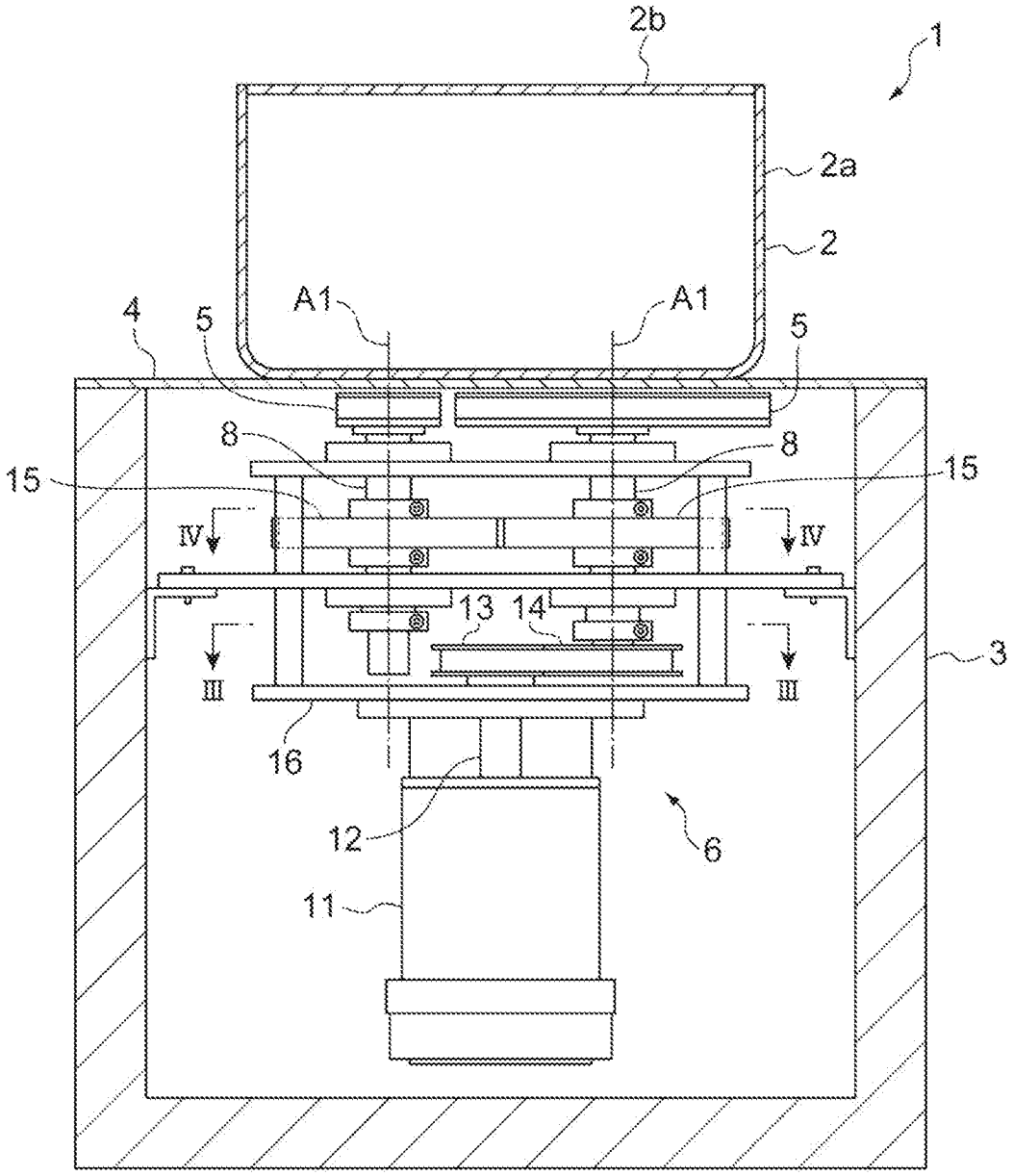
FIG. 1 is a schematic cross-sectional view of a magnetic polishing machine according to a first embodiment.

Hereinafter, preferred embodiments of the invention will be described in detail with reference to the drawings. Furthermore, in the following description, the same or equivalent components are indicated by the same reference numerals and a repetitive description is omitted.

First Embodiment

As illustrated in FIG. 1, a magnetic polishing machine 1 according to a first embodiment includes a container 2 and a magnetic field changing device 3.

The container 2 is a container which accommodates a polishing target and a plurality of polishing pieces. The container 2 includes a bottomed container body 2*a* which has an upper opening and a lid 2*b* which opens or closes the opening of the container body 2*a*. The container 2 is formed of non-magnetic metal such as aluminum and a non-magnetic material including resin such as ABS resin and polypropylene.

The polishing target accommodated in the container 2 is formed of a non-magnetic material. The polishing target is not particularly limited, but for example, jewelry such as rings, ring frames, pendants, and brooches, precise mechanical parts such as screws, shafts, and clock hands, parts of integrated circuits, and the like are used.

The polishing piece accommodated in the container 2 is formed of a magnetic material having weak magnetism such as stainless. The polishing piece is not particularly limited, but for example, small pieces respectively having a pin shape, a rod shape, a plate shape, and a spherical shape are used. Furthermore, in addition to the polishing target and the polishing piece, a solution of a surfactant, a solution of a polishing aid, or the like may be injected into the container 2.

The magnetic field changing device 3 is a device which places the container 2 thereon and changes a magnetic field to move the polishing pieces accommodated in the container 2. The magnetic field changing device 3 includes a separation plate 4, a plurality of rotation plates 5, and a first rotation mechanism 6.

The separation plate 4 is a member that places the container 2 thereon and separates the rotation plate 5 from the container 2 placed thereon. The separation plate 4 is formed of a flat plate and is disposed horizontally. Then, the container 2 is placed on the separation plate 4 to be disposed above the plurality of rotation plates 5 in a fixed manner. The separation plate 4 is formed of a non-magnetic material. As the separation plate 4, rigid materials such as a tempered glass plate, an aluminum plate, and a reinforced plastic plate are used.

Figure 2:
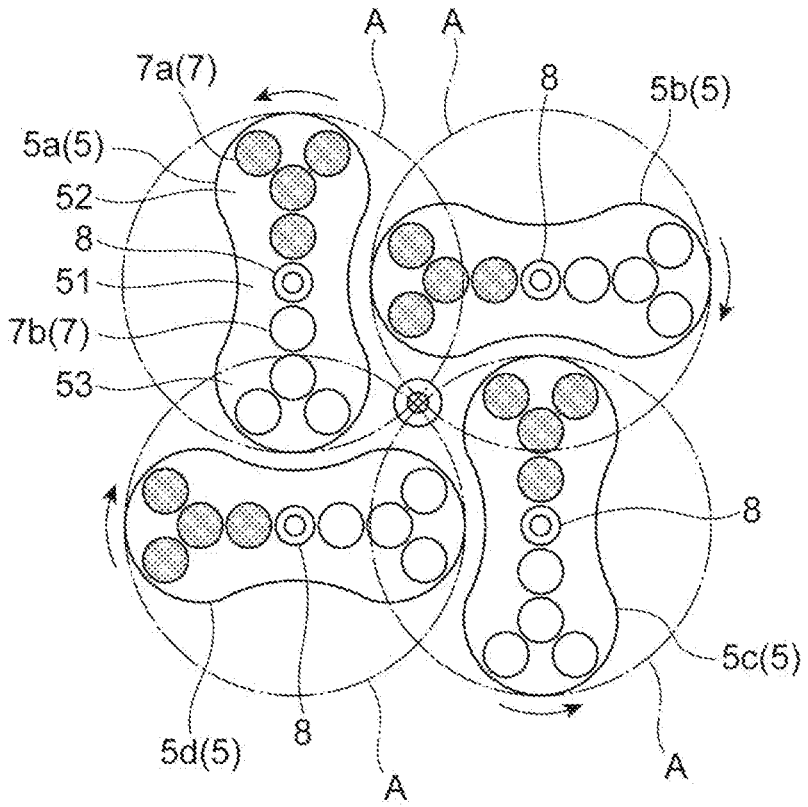
FIG. 2 is a diagram illustrating an arrangement of a rotation plate.
Figure 3:
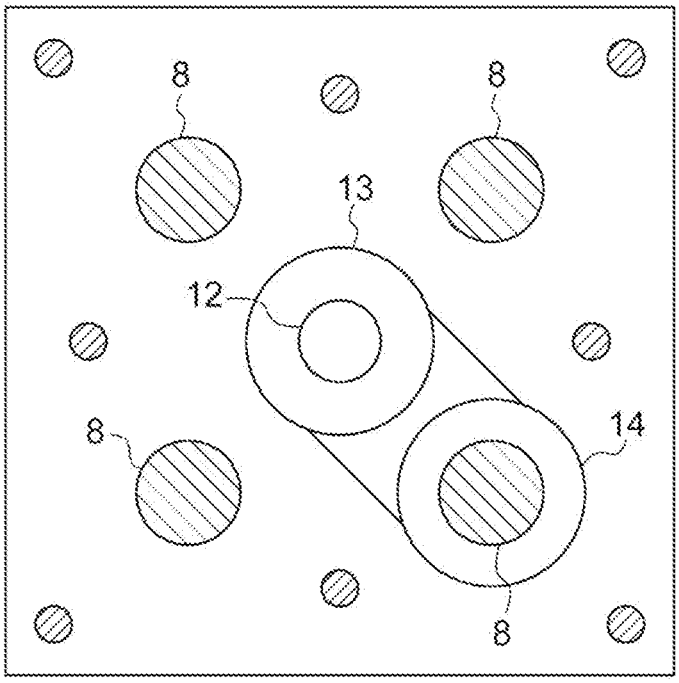
FIG. 3 is a schematic cross-sectional view taken along a line III-III illustrated in FIG. 1.
Figure 4:
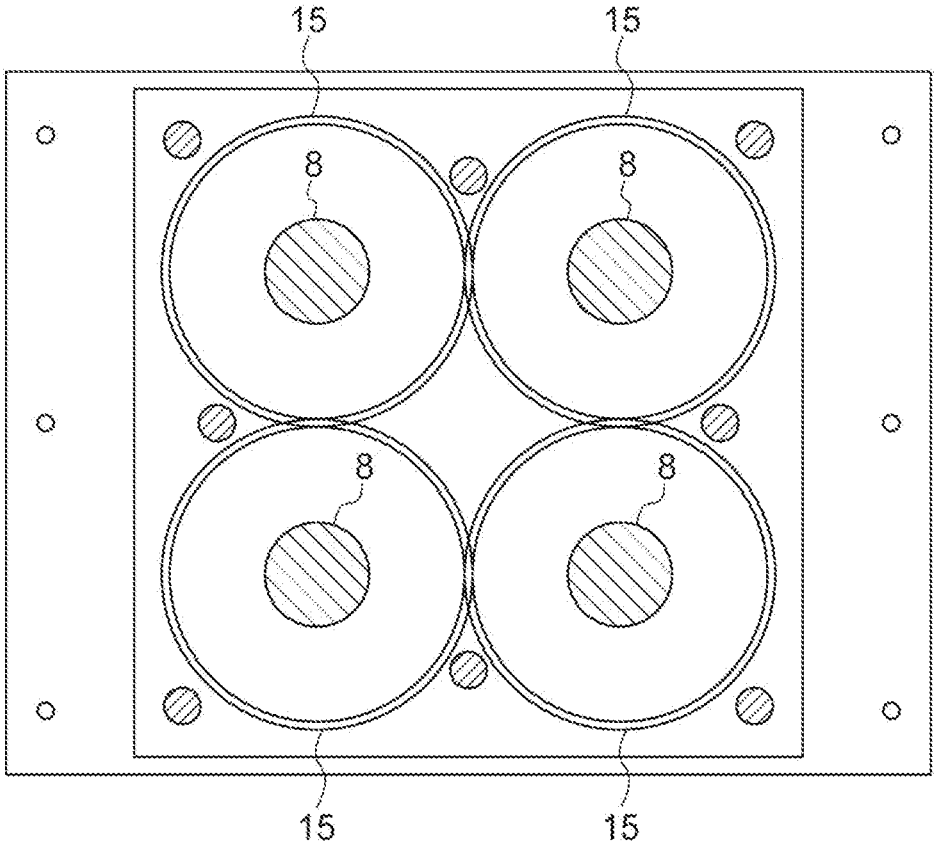
FIG. 4 is a schematic cross-sectional view taken along a line IV-IV illustrated in FIG. 1.

As illustrated in FIGS. 1 and 2, the rotation plate 5 is a member that is rotatably disposed below the container 2 while a magnet 7 is attached thereto. Specifically, the rotation plate 5 is disposed at a position slightly separated from the separation plate 4 and located below the separation plate 4.

The magnetic field changing device 3 is provided with four rotation plates 5 including a rotation plate 5*a*, a rotation plate 5*b*, a rotation plate 5*c*, and a rotation plate 5*d*. In the plan view, the rotation axes of the rotation plates 5*a* to 5*d* are disposed at the positions corresponding to the vertexes of the square and pass through the container 2 placed on the separation plate 4. Then, the rotation plate 5*b* is disposed in the vicinity of the rotation plate 5*a*, the rotation plate 5*c* is disposed in the vicinity of the rotation plate 5*b*, the rotation plate 5*d* is disposed in the vicinity of the rotation plate 5*c*, and the rotation plate 5*a* is disposed in the vicinity of the rotation plate 5*d*. Furthermore, since the rotation plates 5*a* to 5*d* basically have the same shape, these rotation plates will be hereinafter generally described as the rotation plate 5 except for a case in which these rotation plates need to be particularly distinguished.

A rotation shaft 8 is connected to each of the rotation plates 5*a* to 5*d* and each rotation shaft 8 is rotatably held by the first rotation mechanism 6. The rotation axes A1 (the rotation shafts 8) of the rotation plates 5*a* to 5*d* are disposed in parallel. Furthermore, since the separation plate 4 is horizontally disposed, the rotation axis A1 becomes a vertical line extending in the vertical direction. Then, the rotation plate 5*a* and the rotation plate 5*c* are rotated by the first rotation mechanism 6 in directions opposite to those of the rotation plate 5*b* and the rotation plate 5*d*. For example, the rotation plate 5*a* and the rotation plate 5*c* rotate in the counterclockwise rotation direction and the rotation plate 5*b* and the rotation plate 5*d* rotate in the clockwise rotation direction.

The adjacent rotation plates 5 are disposed at a position in which the rotation areas A partially overlap each other. The rotation area A is an area through which the rotating rotation plate 5 passes and is a circular area which is surrounded by a one-dotted chain line of FIG. 2 and is centered on the rotation axis A1. For this reason, a gap between the rotation axes A1 (the rotation shafts 8) of the adjacent rotation plates 5 is shorter than the diameter of the rotation area A of the rotation plate 5.

The rotation plate 5 is formed in a shape which maintains a substantially uniform separation distance with respect to the adjacent rotation plate 5 when the rotation plate is rotated by the first rotation mechanism 6. An outer shape of the rotation plate 5 can be formed as, for example, an involute curve or the like. That is, the involute curves of four rotation plates engaging with one another are calculated and a line slightly smaller than the involute curves is set as an outer shape line of the rotation plate 5. Accordingly, the rotation plate 5 can maintain a substantially uniform separation distance with respect to the adjacent rotation plate 5 when the rotation plate is rotated by the first rotation mechanism 6. Furthermore, the separation distance of the adjacent rotation plates 5 may not be essentially substantially uniform and may enter within a predetermined range. In this case, the range of the separation distance depends on the size or the like of the rotation plate 5 and is, for example, preferably 5 mm or more and 30 mm or less, further preferably 8 mm or more and 25 mm or less, and particularly preferably 10 mm or more and 20 mm or less.

Specifically, the rotation plate 5 is formed in a deformed elliptical shape which is called a gourd type, an eyebrow shape, or the like with a center portion being thin and both end portions being thick. The rotation plate 5 includes a center portion 51 which is located at a center portion and to which the rotation shaft 8 is connected and first and second portions 52 and 53 which extend in the opposite directions from the center portion 51. For this reason, the first portion 52 and the second portion 53 extend in the opposite directions from the rotation axis A1. The center portion 51 is thinned and the first portion 52 and the second portion 53 are rounded and thickened. Then, the plurality of magnets 7 are attached to each of the first portion 52 and the second portion 53. An attachment structure of the magnet 7 with respect to the rotation plate 5 is not particularly limited, but for example, a structure in which the magnet is inserted into a concave portion formed in the rotation plate 5 and the concave portion is covered with a lid can be used.

A first magnet 7*a* disposed so that an upper surface becomes an N pole is attached to the first portion 52 as the magnet 7. A first magnet 7*a* disposed so that an upper surface becomes an S pole is attached to the second portion 53 as the magnet 7. For this reason, both of the first magnet 7*a* and a second magnet 7*b* are attached to one rotation plate 5 as the magnet 7. Furthermore, in the drawings, the first magnet 7*a* is indicated by a black circle and the second magnet 7*b* is indicated by a white circle.

Four first magnets 7*a* of the same size are attached to the first portion 52 and are respectively disposed at the positions corresponding to the center and the vertexes of the triangle. Four second magnets 7*b* of the same size are attached to the second portion 53 and are respectively disposed at the positions corresponding to the center and the vertexes of the triangle. Then, the rotation plate 5 is formed in a shape which is symmetrical (point-symmetrical and line-symmetrical) with respect to the rotation axis A1 as a reference and four first magnets 7*a* and four second magnets 7*b* are disposed at the symmetrical (point-symmetrical and line-symmetrical) positions with respect to the rotation axis A1 as a reference.

The first rotation mechanism 6 rotates the rotation plates 5*a* to 5*d* about the rotation axes A1 of the rotation plates 5*a* to 5*d*. Specifically, as illustrated in FIGS. 1 to 4, the first rotation mechanism 6 includes a motor 11, a rotation shaft 12 of the motor 11, a pulley 13 which is fixed to the rotation shaft 12, a pulley 14 which is fixed to the rotation shaft 8 connected to any one of the rotation plates 5*a* to 5*d*, four connection gears 15 which are fixed to the rotation shafts 8 of the rotation plates 5*a* to 5*d*, and a support body 16 which rotatably and integrally support the rotation shafts 8 of the rotation plates 5*a* to 5*d*.

An endless belt is stretched around the pulley 13 fixed to the rotation shaft 12 and the pulley 14 fixed to the rotation shaft 8. Four connection gears 15 fixed to the rotation shafts 8 of the rotation plates 5*a* to 5*d* engage with one another. Specifically, the connection gear 15 which is fixed to the rotation shaft 8 of the rotation plate 5*a* engages with the connection gear 15 which is fixed to the rotation shaft 8 of the rotation plate 5*b*, the connection gear 15 which is fixed to the rotation shaft 8 of the rotation plate 5*b* engages with the connection gear 15 which is fixed to the rotation shaft 8 of the rotation plate 5*c*, the connection gear 15 which is fixed to the rotation shaft 8 of the rotation plate 5*c* engages with the connection gear 15 which is fixed to the rotation shaft 8 of the rotation plate 5*d*, and the connection gear 15 which is fixed to the rotation shaft 8 of the rotation plate 5*d* engages with the connection gear 15 which is fixed to the rotation shaft 8 of the rotation plate 5*a*. The support body 16 is directly or indirectly fixed to the casing of the magnetic field changing device 3.

Next, an operation of the magnetic polishing machine 1 will be described. First, the container 2 which accommodates the polishing target and the plurality of polishing pieces is placed on the separation plate 4. Then, the motor 11 is rotated. Then, the motor 11 rotates the rotation shaft 12 to transmit a rotational force from the pulley 13 to the pulley 14. The rotational force transmitted to the pulley 14 is transmitted from the connection gear 15 connected to the rotation shaft 8 to which the pulley 14 is fixed to the remaining three connection gears 15 fixed to the remaining rotation shafts 8. Then, four connection gears 15 rotate so that the rotation plates 5*a* to 5*d* rotate through the rotation shafts 8. Accordingly, the rotation plate 5*a* and the rotation plate 5*c* rotate in directions opposite to those of the rotation plate 5*b* and the rotation plate 5*d*.

Figure 5:
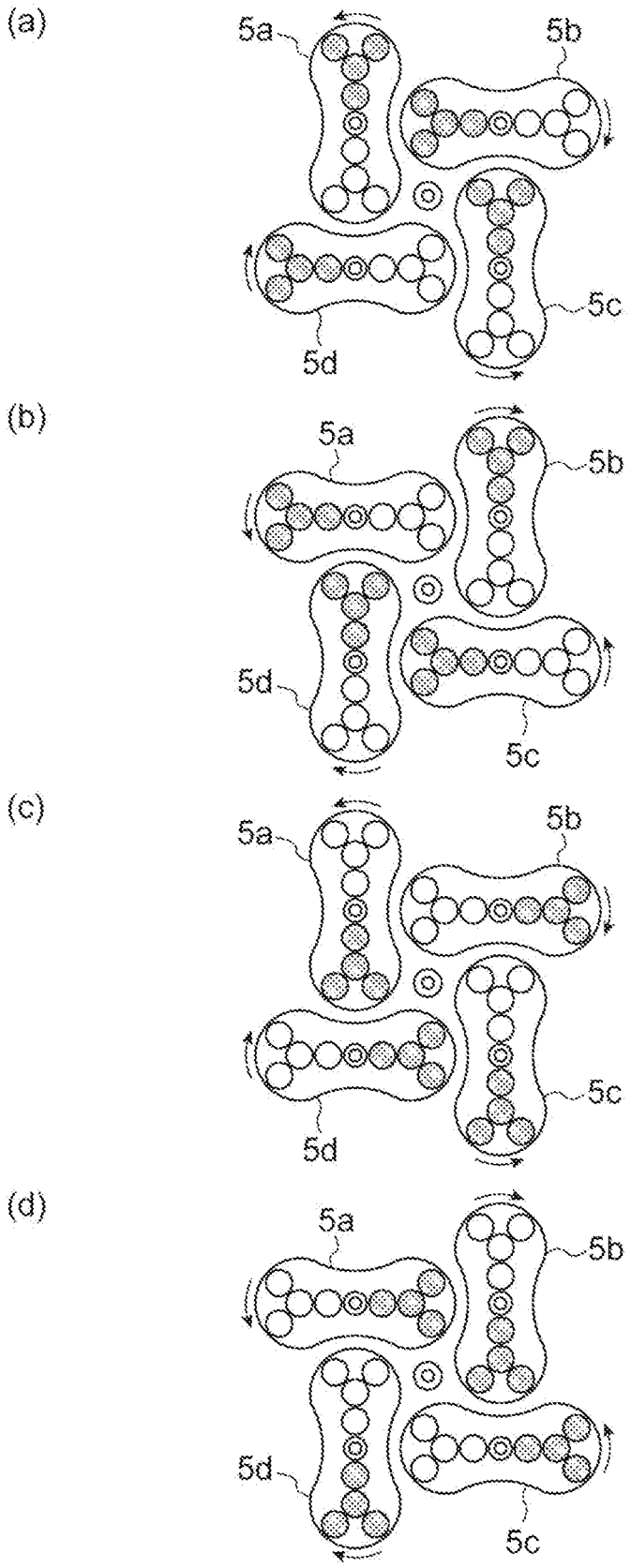
FIGS. 5(*a*), 5(*b*), 5(*c*), and 5(*d*) are diagrams illustrating a rotation state of the rotation plate.

In this way, when the first rotation mechanism 6 rotates the rotation plates 5*a* to 5*d*, the rotation plates 5*a* to 5*d* respectively rotate in order of FIGS. 5(*a*), 5(*b*), 5(*c*), and 5(*d*). Then, the first magnet 7*a* and the second magnet 7*b* attached to the rotation plates 5*a* to 5*d* change a magnetic field inside the container 2. Accordingly, the plurality of polishing pieces accommodated in the container 2 jump while spinning so that the polishing target accommodated in the container 2 is polished.

As described above, in the magnetic polishing machine 1 according to the embodiment, since the plurality of rotation plates 5 are disposed below the container 2, the polishing pieces polish the polishing target while being influenced by the magnetic forces of the rotation plates 5. Here, the center portion 51 of each rotation plate 5 is not easily influenced by the magnetic force and a centrifugal force is applied to the polishing pieces when each rotation plate 5 rotates. However, since the plurality of rotation plates 5 are disposed below the container 2, the polishing pieces in the entire container 2 are mixed by the centrifugal force of the polishing piece with the rotation of each rotation plate 5. For this reason, it is possible to suppress a decrease in amount of the polishing target also above the center portion 51 of each rotation plate 5 and in the vicinity of the rotation axis A1 of each rotation plate 5. Accordingly, it is possible to suppress polishing unevenness.

Further, since the container 2 is disposed above the plurality of rotation plates 5 in a fixed manner, it is possible to suppress an increase in size of the entire machine.

Further, since the rotation axis A1 of each rotation plate 5 passes through the container 2, it is possible to densely dispose the rotation plates 5. Accordingly, it is possible to suppress an increase in size of the entire machine.

Further, since four rotation plates 5*a* to 5*d* disposed below the container 2 include the first portion 52 and the second portion 53 extending in the opposite directions from the rotation axis A1, it is possible to densely dispose four rotation plates 5*a* to 5*d*. Accordingly, the small polishing pieces can be easily mixed as a whole and the movement of the small polishing pieces can be further complicated.

Further, since a predetermined separation distance with respect to the adjacent rotation plates 5 is maintained when the rotation plate 5 rotates, it is possible to extremely decrease a range not influenced by the magnetic force of the rotation plate 5 and to move the polishing pieces inside the container 2 in a complicated manner. Accordingly, it is possible to further suppress polishing unevenness.

Further, since the magnets of opposite polarities are attached to one rotation plate 5, it is possible to cause the polishing pieces to jump while spinning by the rotation of one rotation plate 5. For this reason, it is possible to move the polishing pieces in a more complicated manner by rotating the plurality of rotation plates 5.

Second Embodiment

Next, a magnetic polishing machine according to a second embodiment will be described. The second embodiment is basically the same as the first embodiment, but is different from the first embodiment only in that a configuration for integrally rotating the rotation plates is added. For this reason, in the description below, only a different point from the first embodiment will be described and the same point as that of the first embodiment will not be described.

Figure 6:
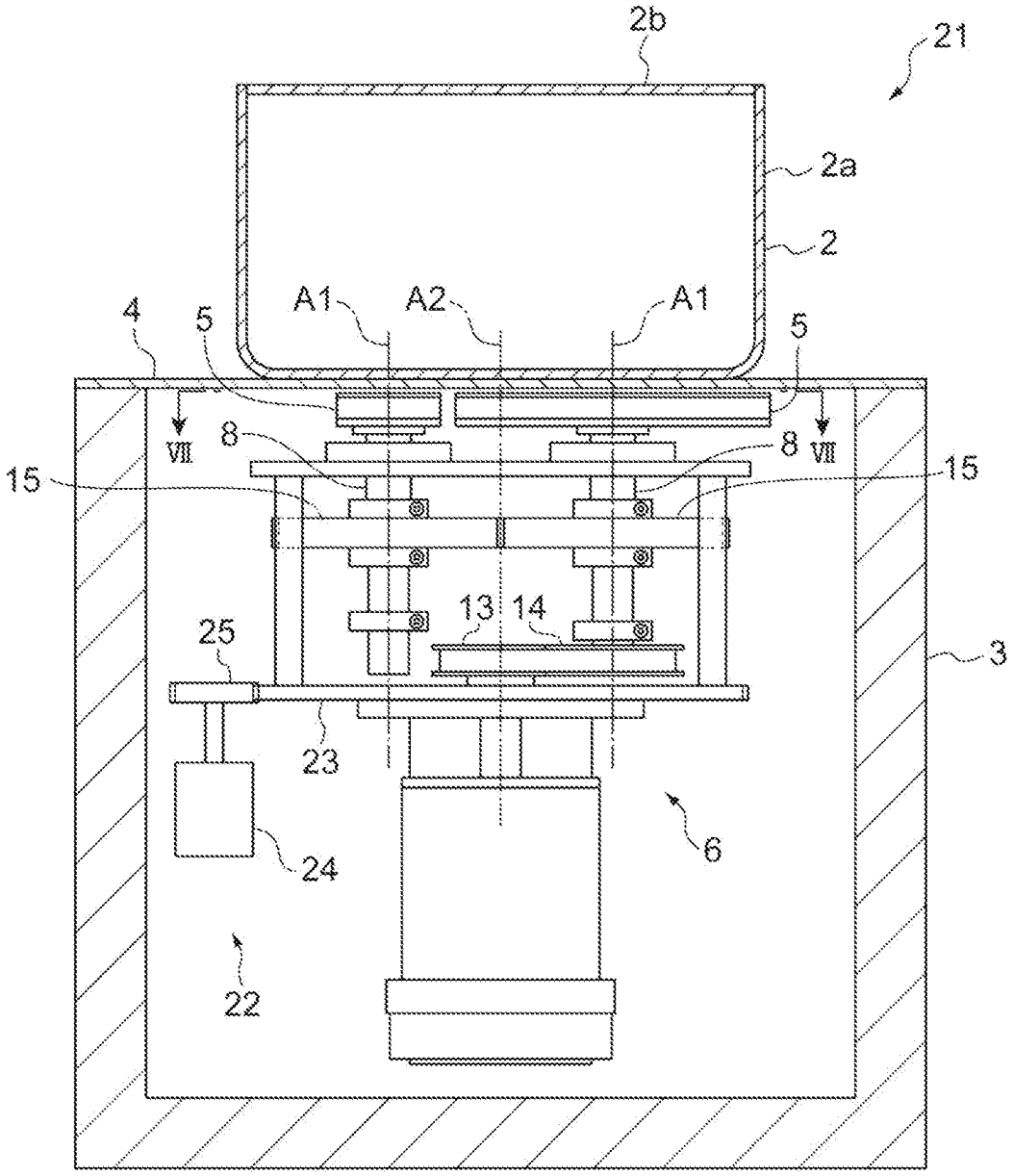
FIG. 6 is a schematic cross-sectional view of a magnetic polishing machine according to a second embodiment.

As illustrated in FIG. 6, in a magnetic polishing machine 21 according to the second embodiment, the magnetic field changing device 3 further includes a support member 23 and a second rotation mechanism 22.

The support member 23 is a member that rotatably and integrally supports the rotation plates 5*a* to 5*d*. Specifically, the support member 23 rotatably supports the rotation shaft 8 connected to each of the rotation plates 5*a* to 5*d*. Further, the support member 23 is rotatably supported by the casing of the magnetic field changing device 3. The rotation axis A2 of the support member 23 is parallel to the rotation axis A1 of the rotation plate 5 and is located at the center of the rotation axis A1 of each of the rotation plates 5*a* to 5*d*. For this reason, each of the rotation plates 5*a* to 5*d* is rotatable about the rotation axis A1 and is rotatable about the rotation axis A2.

Figure 7:
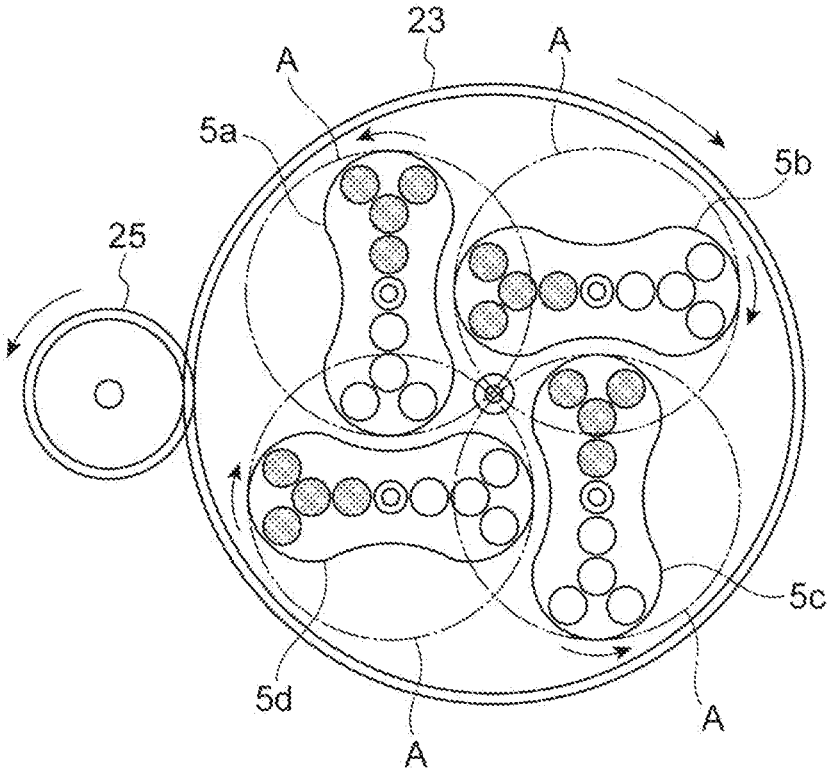
FIG. 7 is a diagram illustrating a rotation operation of a rotation plate.

The second rotation mechanism 22 rotates the support member 23 about the rotation axis A2. Specifically, as illustrated in FIGS. 6 and 7, the second rotation mechanism 22 includes a motor 24 and a connection gear 25 which is fixed to the rotation shaft of the motor 24. Then, the connection gear 25 engages with the support member 23. Furthermore, a structure in which the connection gear 25 engages with the support member 23 is not particularly limited. However, for example, an outer peripheral surface of the support member 23 may be formed as a gear and the connection gear 25 may engage with that gear.

Figure 8:
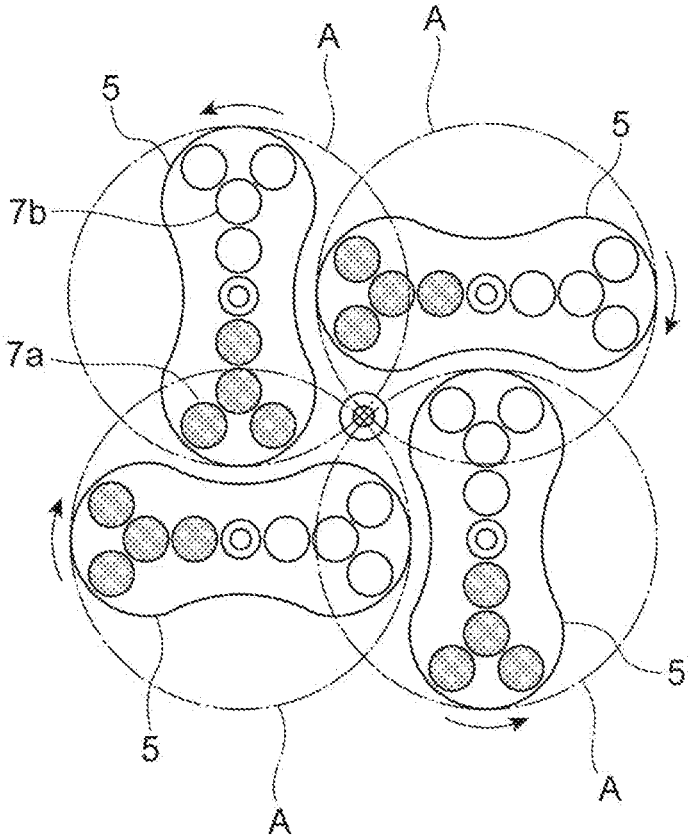
FIG. 8 is a diagram illustrating a modified example of the rotation plate.

Then, the motor 11 of the first rotation mechanism 6 is rotated and the motor 24 of the second rotation mechanism. 22 is rotated at the time of polishing the polishing target. Then, as illustrated in FIG. 8, the rotation plates 5*a* to 5*d* are rotated about the rotation axis A1 by the first rotation mechanism 6 and the support member 23 is rotated about the rotation axis A2 by the second rotation mechanism 22. Accordingly, the plurality of polishing pieces accommodated in the container 2 jump while spinning so that the polishing target accommodated in the container 2 is polished.

In this way, in the magnetic polishing machine 21 according to the embodiment, when the second rotation mechanism 22 rotates the support member 23, the rotation axis A1 of each of the rotation plates 5*a* to 5*d* rotates about the rotation axis A2 of the support member 23. Accordingly, since it is possible to further promote the mixing of the polishing pieces, it is possible to further suppress polishing unevenness.

Although the preferred embodiments of the invention have been described above, the invention is not limited to the above-described embodiments, but may be modified within the scope not changing the gist described in each claim or be applied to another.

For example, in the above-described embodiment, the arrangement of the first magnet and the second magnet has been described in detail, but the arrangement of the first magnet and the second magnet can be appropriately changed. For example, as illustrated in FIG. 8, the arrangement of the first magnet 7*a* and the second magnet 7*b* may be appropriately inversed.

Figure 9:
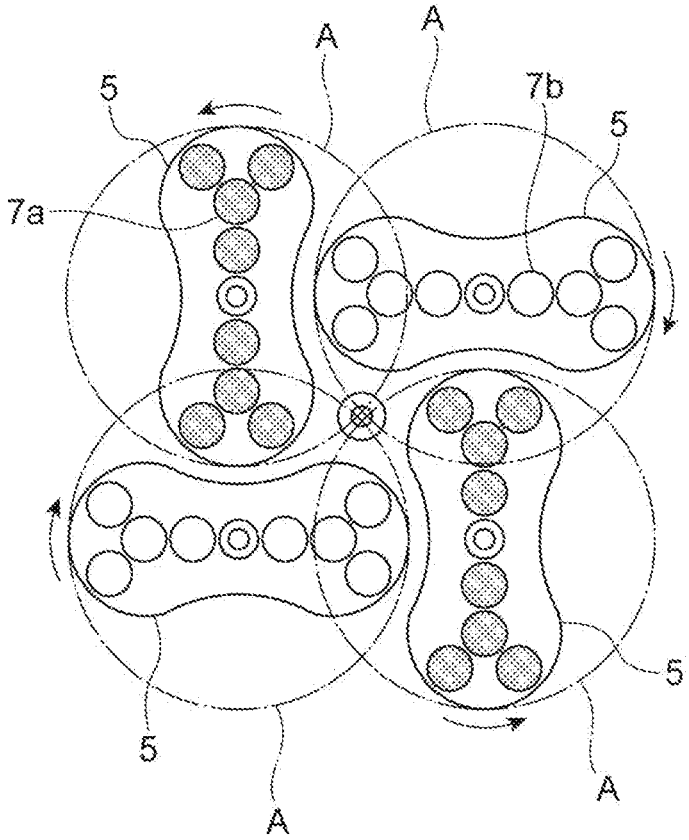
FIG. 9 is a diagram illustrating a modified example of the rotation plate.

Further, as illustrated in FIG. 9, only one of a first magnet 7*a* disposed so that an upper surface becomes an N pole and a second magnet 7*b* disposed so that an upper surface becomes an S pole may be attached to one rotation plate 5 as the magnet 7. In this case, the rotation plate 5 to which only the first magnet 7*a* is attached and the rotation plate 5 to which only the second magnet 7*b* is attached may be adjacent to each other. In this case, it is possible to cause the polishing pieces to jump while spinning by attaching the magnets of opposite polarities to the adjacent rotation plates. In this way, it is possible to easily manufacture the rotation plate 5 by attaching the magnets of the same polarity to one rotation plate 5.

Further, in the above-described embodiment, the number, the shape, the size, the arrangement, and the like of the magnet attached to the rotation plate have been described in detail, but the number, the shape, the size, the arrangement, and the like of the magnet attached to the rotation plate can be appropriately changed.

Figure 10:
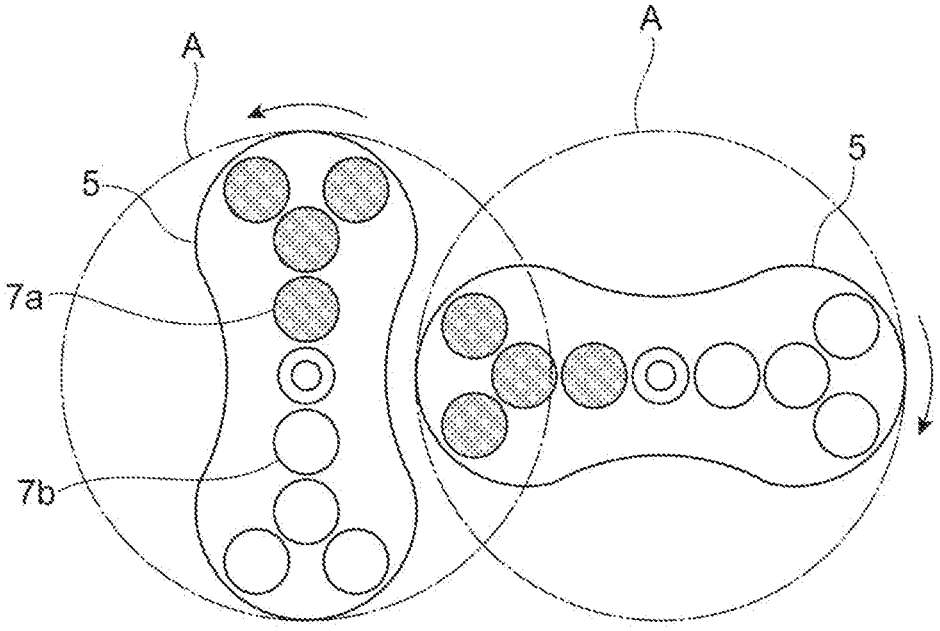
FIG. 10 is a diagram illustrating a modified example of the rotation plate.

Further, in the above-described embodiment, a case has been described in which four rotation plates are disposed at the positions corresponding to the center and the vertexes of the square below the container, but the number, the arrangement, and the like of the rotation plate disposed below the container can be appropriately changed. For example, as illustrated in FIG. 10, two rotation plates 5 may be disposed below the container.

Further, in the above-described embodiment, a case has been described in which the rotation plate is formed in a deformed elliptical shape, but the shape of the rotation plate is not particularly limited and can be appropriately changed.

REFERENCE SIGNS LIST

1: magnetic polishing machine, 2: container, 2*a*: container body, 2*b*: lid, 3: magnetic field changing device, 4: separation plate, 5 (5*a* to 5*d*): rotation plate, 51: center portion, 52: first portion, 53: second portion, 6: first rotation mechanism, 7: magnet, 7*a*: first magnet, 7*b*: second magnet, 8: rotation shaft, 11: motor, 12: rotation shaft, 13: pulley, 14: pulley, 15: connection gear, 16: support body, 21: magnetic polishing machine, 22: second rotation mechanism, 23: support member, 24: motor, 25: connection gear, A: rotation area, A1: rotation axis, A2: rotation axis.

The invention claimed is:

1. A magnetic polishing machine comprising:

a container which accommodates a polishing target and a plurality of magnetic polishing pieces:

a plurality of rotation plates rotatably disposed below the container, wherein each of the plurality of rotation plates rotates about a respective rotation axis, and wherein each rotation plate has a magnet attached thereto; and a first rotation mechanism which rotates each rotation plate about its respective rotation axis, wherein rotation of each of the rotation plates defines a respective plate rotation area and the plurality of rotation plates are positioned such that adjacent plate rotation areas partially overlap each other, such that rotation of the plurality of rotation plates causes a magnetic field to move the magnetic polishing pieces to polish the target.

2. The magnetic polishing machine according to claim 1, wherein the container is disposed above the plurality of rotation plates in a fixed manner.

3. The magnetic polishing machine according to claim 1, wherein the rotation axis of each rotation plate passes through the container.

4. The magnetic polishing machine according to claim 1, wherein four rotation plates are disposed below the container.

5. The magnetic polishing machine according to claim 4, wherein each rotation plate has a deformed elliptical shape in which a center portion is thin and both end portions are thick and includes a first portion and a second portion extending in mutually opposite directions from the rotation axis of the rotation plate, and wherein a plurality of the magnets are attached to each of the first portion and the second portion.

6. The magnetic polishing machine according to claim 1, wherein each rotation plate is formed in a shape which maintains a substantially uniform separation distance with respect to an adjacent rotation plate when the rotation plates are rotated by the first rotation mechanism.

7. The magnetic polishing machine according to claim 1, wherein the magnet comprises a first magnet and a second magnet, wherein the first magnet is disposed so that a first upper surface portion of each plate becomes an N pole and the second magnet is disposed so that a second upper surface portion of each plate becomes an S pole.

8. The magnetic polishing machine according to claim 1, wherein a first magnet is disposed so that an upper surface portion of one rotation plate becomes an N pole, or a second magnet is disposed so that an upper surface portion of one rotation plate becomes an S pole.

9. The magnetic polishing machine according to claim 1, further comprising:

a support member coupled to the rotation plates; and a second rotation mechanism which rotates the support member.

* * * * *